US009127913B2

(12) United States Patent
Neff et al.

(10) Patent No.: US 9,127,913 B2
(45) Date of Patent: Sep. 8, 2015

(54) ROUTE SEARCH PLANNER

(75) Inventors: Michael G. Neff, Lake St. Louis, MO (US); Shirley N. Cheng, Richmond Heights, MO (US); Ted L. Johnson, Florissant, MO (US); Chang-Shaung R. Lee, Town and Country, MO (US)

(73) Assignee: The Boeing Company, Chicago, IL (US)

( * ) Notice: Subject to any disclaimer, the term of this patent is extended or adjusted under 35 U.S.C. 154(b) by 664 days.

(21) Appl. No.: 12/834,867

(22) Filed: Jul. 12, 2010

(65) Prior Publication Data

US 2010/0274487 A1 Oct. 28, 2010

Related U.S. Application Data

(62) Division of application No. 11/383,907, filed on May 17, 2006, now abandoned.

(51) Int. Cl.
*G01C 21/00* (2006.01)
*F41G 7/34* (2006.01)

(52) U.S. Cl.
CPC ..... *F41G 7/343* (2013.01)

(58) Field of Classification Search
None
See application file for complete search history.

(56) References Cited

U.S. PATENT DOCUMENTS 5,508,928 A * 4/1996 Tran ..... 342/13
5,587,904 A * 12/1996 Ben-Yair et al. ..... 701/470
5,631,640 A * 5/1997 Deis et al. ..... 340/961
5,838,262 A * 11/1998 Kershner et al. ..... 340/945
5,850,617 A * 12/1998 Libby ..... 701/25
5,883,586 A * 3/1999 Tran et al. ..... 340/945
6,043,757 A * 3/2000 Patrick ..... 340/963
6,122,572 A * 9/2000 Yavnai ..... 701/23
6,175,804 B1 * 1/2001 Szczerba ..... 701/410
6,182,007 B1 * 1/2001 Szczerba ..... 701/423
6,223,143 B1 * 4/2001 Weinstock et al. ..... 703/17
6,266,610 B1 * 7/2001 Schultz et al. ..... 701/528
6,334,344 B1 * 1/2002 Bonhoure et al. ..... 70/11
6,577,947 B1 * 6/2003 Kronfeld et al. ..... 701/528
6,672,534 B2 * 1/2004 Harding et al. ..... 244/3.15
6,687,606 B1 * 2/2004 Moitra et al. ..... 701/400
6,704,692 B1 * 3/2004 Banerjee et al. ..... 702/189
6,744,382 B1 * 6/2004 Lapis et al. ..... 340/971
6,763,325 B1 * 7/2004 Stone ..... 703/8
6,822,583 B2 * 11/2004 Yannone et al. ..... 340/945
6,995,660 B2 * 2/2006 Yannone et al. ..... 340/425.5
7,132,961 B2 * 11/2006 Yannone et al. ..... 340/961
7,148,835 B1 * 12/2006 Bricker et al. ..... 342/20
7,165,747 B2 * 1/2007 Artini et al. ..... 244/137.1
7,194,397 B1 * 3/2007 Bush ..... 703/8
7,231,294 B2 * 6/2007 Bodin et al. ..... 701/23
7,243,008 B2 * 7/2007 Stockdale et al. ..... 701/3

(Continued)

*Primary Examiner* — Jonathan M Dager

(57) ABSTRACT

Route search planner methods and systems are described. In an embodiment, a probability map can be generated from previous sensor scans combined with a projected target location of relocatable targets in a target area. A route can be generated by a route generator, based at least in part on the probability map, and based on optimal system performance capabilities utilized to search for at least one of the relocatable targets. A search manager can then assign an evaluation criteria value to the route based on route evaluation criteria, and compare the evaluation criteria value to other evaluation criteria values corresponding to respective previously generated routes to determine an optimal route. The search manager can then determine whether to generate one or more additional routes and assign additional evaluation criteria values for comparison to determine the optimal route.

13 Claims, 9 Drawing Sheets

(56) References Cited

U.S. PATENT DOCUMENTS

| | | | | |
|---|---|---|---|---|
| 7,248,952 | B2 * | 7/2007 | Ma et al. | 701/25 |
| 7,272,492 | B2 * | 9/2007 | McCubbin et al. | 701/533 |
| 7,415,331 | B2 * | 8/2008 | Dapp et al. | 701/25 |
| 7,515,974 | B2 * | 4/2009 | Black et al. | 700/28 |
| 7,599,765 | B2 * | 10/2009 | Padan | 701/3 |
| 7,627,456 | B2 * | 12/2009 | Hansen | 702/187 |
| 8,078,319 | B2 * | 12/2011 | Franke et al. | 700/248 |
| 2002/0073101 | A1 * | 6/2002 | Stoyen | 707/104.1 |
| 2003/0158744 | A1 * | 8/2003 | Moitra et al. | 705/1 |
| 2003/0213358 | A1 * | 11/2003 | Harding | 89/1.11 |
| 2003/0229442 | A1 * | 12/2003 | Mattheyses et al. | 701/202 |
| 2004/0006424 | A1 * | 1/2004 | Joyce et al. | 701/207 |
| 2004/0061595 | A1 * | 4/2004 | Yannone et al. | 340/425.5 |
| 2004/0068372 | A1 * | 4/2004 | Ybarra et al. | 701/301 |
| 2004/0140912 | A1 * | 7/2004 | Alfredsson et al. | 340/945 |
| 2005/0004723 | A1 * | 1/2005 | Duggan et al. | 701/24 |
| 2005/0216182 | A1 * | 9/2005 | Hussain et al. | 701/200 |
| 2006/0053534 | A1 * | 3/2006 | Mullen | 2/456 |
| 2006/0058954 | A1 * | 3/2006 | Haney | 701/209 |
| 2006/0142903 | A1 * | 6/2006 | Padan | 701/3 |
| 2006/0184292 | A1 * | 8/2006 | Appleby et al. | 701/23 |
| 2006/0238403 | A1 * | 10/2006 | Golan et al. | 342/62 |
| 2006/0271245 | A1 * | 11/2006 | Herman | 701/1 |
| 2007/0021879 | A1 * | 1/2007 | DelNero et al. | 701/23 |
| 2007/0023582 | A1 * | 2/2007 | Steele et al. | 244/190 |
| 2008/0015909 | A1 * | 1/2008 | De et al. | 705/7 |
| 2008/0208397 | A1 * | 8/2008 | Miklos | 701/3 |
| 2010/0104185 | A1 * | 4/2010 | Johnson et al. | 382/173 |
| 2011/0184604 | A1 * | 7/2011 | Franke et al. | 701/23 |

* cited by examiner

P ( Mission Accomplishment )
Accumulated over the Field of Regard

ROUTE SEARCH PLANNER

This is a divisional of U.S. Ser. No. 11/383,907, filed 17 May 2006 now abandoned.

CROSS REFERENCE TO RELATED APPLICATIONS

This patent application is related to the following co-pending, commonly-owned U.S. Patent Applications: U.S. patent application Ser. No. 2010-0104185 A1entitled "Methods and Systems for the Detection of the Insertion, Removal, and Change of Objects Within a Scene Through the Use of Imagery" filed on May 17, 2006; U.S. patent application Ser. No. 2007-0268364 A1 entitled "Moving Object Detection" filed on May 17, 2006; U.S. patent application Ser. No. 2007-0269077 A1 entitled "Sensor Scan Planner" filed on May 17, 2006; and U.S. patent application Ser. No. 2007-0271032 A1 entitled "Methods and Systems for Data Link Front End Filters for Sporadic Updates" filed on May 17, 2006, which applications are incorporated herein by reference.

TECHNICAL FIELD

The present disclosure relates to route search planner.

BACKGROUND

In a conflict environment, the search for relocatable military targets (e.g. moving, or movable targets) typically involves flying one or more airborne weapon systems, such as missiles or other unmanned armaments, into a large area where one or more sensors on each of the weapon systems scan regions of the target area. Prior to deploying an airborne weapon system, it may be programmed with a set of flight path waypoints and a set of sensor scan schedules to enable an on-board guidance and targeting system to conduct a search of the target area in an effort to locate new targets, or targets that may have been previously identified through reconnaissance efforts.

Due to the similar appearance of relocatable targets to other targets and objects within a target area, typical weapon system designs utilize autonomous target recognition algorithm(s) in an effort to complete mission objectives. However, these autonomous target recognition algorithm(s) do not provide the required optimal performance necessary for adaptive relocatable target locating, scanning, and/or detecting.

SUMMARY

In an embodiment of route search planner, a probability map can be generated from previous sensor scans combined with a projected target location of relocatable targets in a target area. A route can be generated by a route generator, based at least in part on the probability map, and based on optimal system performance capabilities utilized to search for at least one of the relocatable targets. A search manager can then assign an evaluation criteria value to the route based on route evaluation criteria, and compare the evaluation criteria value to other evaluation criteria values corresponding to respective previously generated routes to determine an optimal route. The search manager can then determine whether to generate one or more additional routes and assign additional evaluation criteria values for comparison to determine the optimal route.

In another embodiment of route search planner, a route search planner system is implemented as a computing-based system of an airborne platform or weapon system. Probability maps can be generated from previous sensor scans of a target area combined with a projected target location of the relocatable targets in the target area. Flight paths can then be generated for the airborne platform or weapon system to search for at least one of the relocatable targets. The flight paths can be generated based at least in part on the probability maps, and can be evaluated based on route evaluation criteria.

BRIEF DESCRIPTION OF THE DRAWINGS

Embodiments of route search planner are described with reference to the following drawings. The same numbers are used throughout the drawings to reference like features and components.

DETAILED DESCRIPTION

Route search planner is described to adaptively develop future flight paths which are intended to maximize the probability of accomplishing the mission of aircraft such as an unmanned aerial vehicle (UAV), an airborne weapon system such as a missile or other unmanned armament, or any other suitable airborne platforms. Alternatively, embodiments of route search planner may be configured for use with non-aircraft platforms such as land-based vehicles, exo-atmospheric vehicles, and any other suitable platforms. Thus, in the following description, references to "an airborne weapon system" or to "an airborne platform" should not be construed as limiting.

As a component of a larger system, route search planner functions in real-time to provide the best determinable route or flight path to facilitate accomplishing a mission according to pre-determined commit criteria for the aircraft, airborne weapon system, non-aircraft platform, or other mobile platform. The larger, controlling system can generate a synchronization event to initiate the generation of new and/or modified flight paths dynamically and in real-time, such as after an unmanned aerial vehicle or airborne weapon system has been launched and is enroute or has entered into a target area.

The route search planner system can optimize weapons systems, reconnaissance systems, and airborne platform capabilities given the current performance of autonomous target recognition algorithms. The description primarily references "relocatable targets" because the performance of current fixed or stationary target acquisition algorithms is sufficient to meet the requirements of a pre-planned fixed target airborne platform design. However, the systems and methods described herein for route search planner can be utilized for fixed targeting updates, such as for verification of previous reconnaissance information prior to committing to a target.

Route search planner methods and systems are described in which embodiments provide for generating adaptive airborne platform, aircraft, or airborne weapon system flight paths which are based on current system capabilities to optimize relocatable target detection and identification in a target area and, ultimately, to maximize the probability of mission accomplishment. Route search planner develops new or modified routes according to the route pattern capabilities of a route generator, and each route is then evaluated based on route evaluation criteria which includes sensor performance, the performance of autonomous target recognition algorithms, and the commit criteria defined for a particular airborne platform system.

While features and concepts of the described systems and methods for route search planner can be implemented in any number of different environments, systems, and/or configurations, embodiments of route search planner are described in the context of the following exemplary environment and system architectures.

Figure 1:
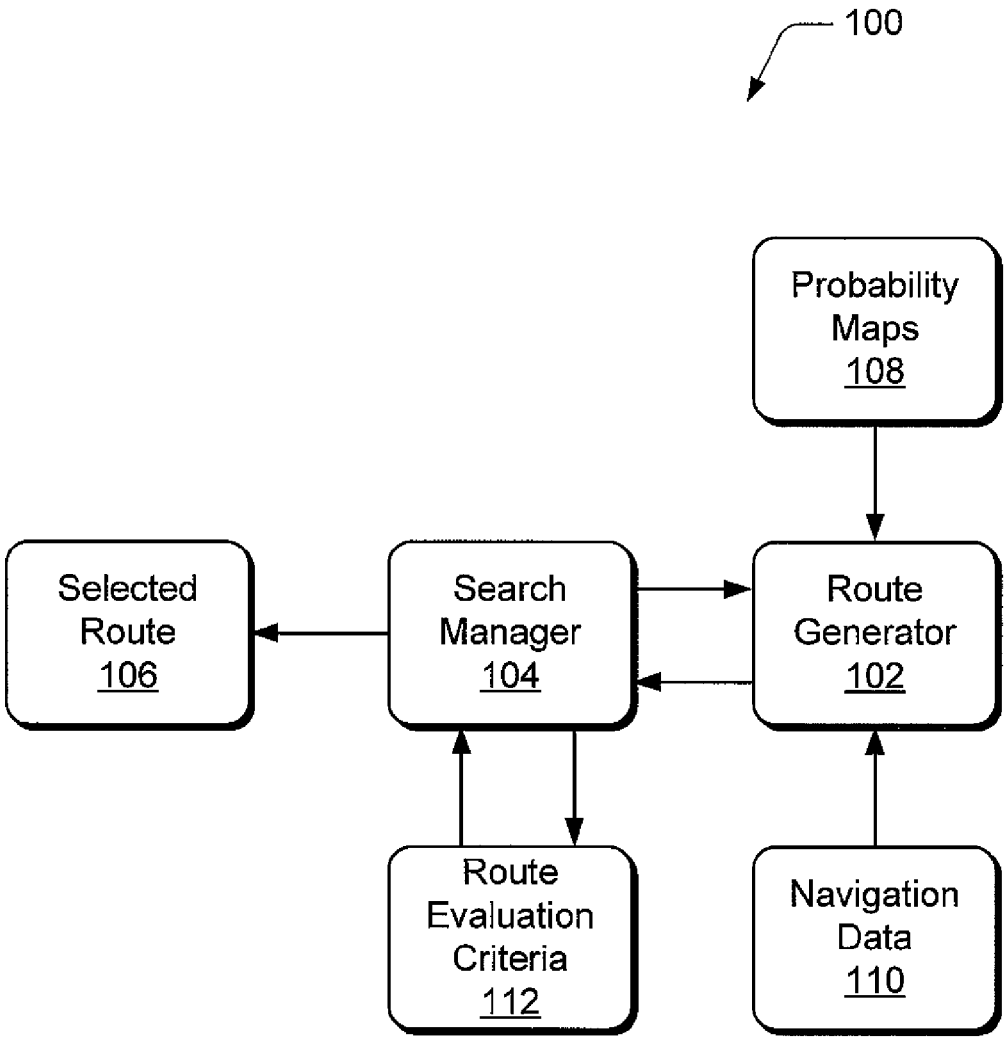
FIG. 1 illustrates an exemplary route search planner system in which embodiments of route search planner can be implemented.

FIG. 1 illustrates an exemplary route search planner system 100 in which embodiments of route search planner can be implemented. The route search planner system 100 generates routes which, in one embodiment, are adaptive airborne platform or weapon system flight paths that are based on the current system capabilities for an optimization that maximizes the probability of mission accomplishment.

The system 100 includes a route generator 102 and a search manager 104. To generate a selected route 106, the route generator 102 utilizes probability maps 108 and navigation data 110 which are data inputs to the route generator 102. The search manager 104 utilizes route evaluation criteria 112 to compare and determine the contribution of a generated route towards accomplishing the mission of an airborne platform or weapon system. In an embodiment, the route search planner system 100 can be implemented as components of a larger system which is described in more detail with reference to FIG. 2.

The probability maps 108 can be generated, at least in part, from previous sensor scans of a region in a target area combined with projected target locations (also referred to as "projected object states") of relocatable targets in the target area. The relocatable targets can be moving or movable military targets in a conflict region, for example. Probability maps 108 are described in more detail with reference to FIG. 2 and FIG. 6. The navigation data 110 provides the system platform three-dimensional position, attitude, and velocity to the route generator 102.

The search manager 104 can initiate the route generator 102 to generate a new or modified route based at least in part on a probability map 108 and/or on the navigation data 110. The route generator 102 can generate the route, such as an airborne platform or weapon system flight path, by which to search and locate a relocatable target. The search manager 104 can then assign an evaluation criteria value to a generated route based on route evaluation criteria 112. The search manager 104 can compare the evaluation criteria value to other evaluation criteria values corresponding to respective previously generated routes to determine an optimal route. The search manager 104 can also determine whether to generate one or more additional routes and assign additional evaluation criteria values for comparison to determine the optimal route. In an embodiment, the search manager 104 can compare the generated route to the route evaluation criteria 112 and determine whether the generated route meets (to include exceeds) a conditional probability threshold, or similar quantifiable metric, based on the route evaluation criteria 112. The conditional probability threshold or quantifiable metric may include, for example, a likelihood of locating a relocatable target if the airborne platform or weapon system is then initiated to travel into a region according to the route.

The route evaluation criteria 112 can include an input of sensor and autonomous target recognition (ATR) capabilities, as well as commit logic that indicates whether to commit the airborne platform or weapon system to a target once identified. The search manager 104 can continue to task the route generator 102 to modify or generate additional routes until an optimal route for mission accomplishment is determined, and/or reaches an exit criteria which may be a threshold function of the route evaluation criteria, a limit on processing time, or any other type of exit criteria.

The route generator 102 can be implemented as a modular component that has a defined interface via which various inputs can be received from the search manager 104, and via which generated routes can be communicated to the search manager 104. As a modular component, the route generator 102 can be changed-out and is adaptable to customer specific needs or other implementations of route generators. For example, a route generator 102 can include defined exclusion zones which indicate areas or regions that an airborne weapon system should not fly through due to the likelihood of being intercepted by an anti-air threat. Additionally, different route generators can include different segment pattern capabilities to define how a route or flight path for an airborne platform or weapon system is generated, such as piecewise linear segmenting to define a circular flight path by linear segments.

Figure 2:
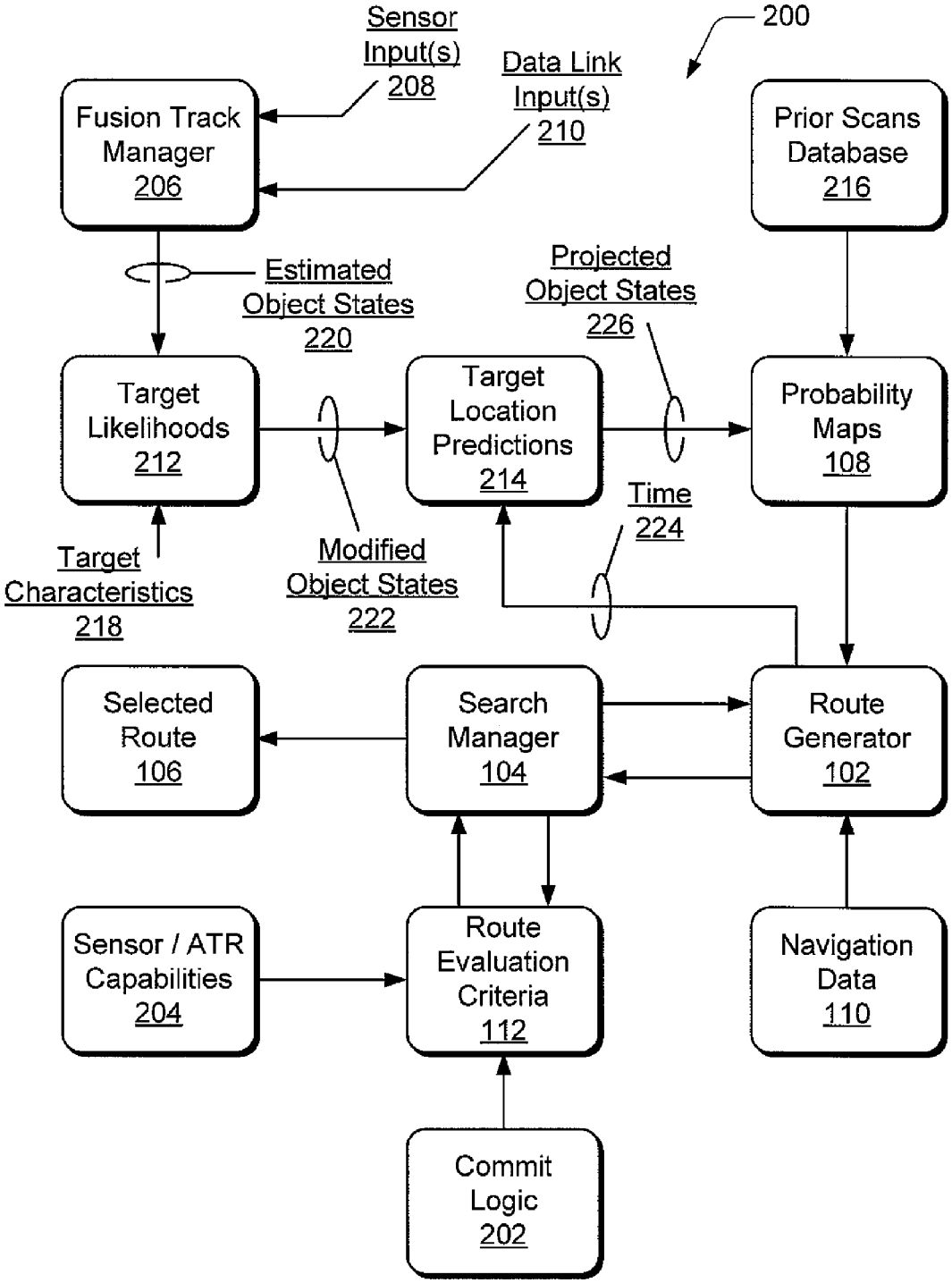
FIG. 2 illustrates an exemplary environment in which embodiments of route search planner can be implemented.

FIG. 2 illustrates an exemplary environment 200 in which embodiments of route search planner can be implemented to determine the selected route 106. The environment 200 includes the components of the route search planner system 100 (FIG. 1), such as the route generator 102, the search manager 104, the probability maps 108, the navigation data 110, and the route evaluation criteria 112. The environment 200 also includes commit logic 202 by which to determine whether to commit a weapon system to a target, and includes sensor and autonomous target recognition (ATR) capabilities 204.

The commit logic 202 includes pre-determined commit criteria for a weapon system, and in a simple example, the commit logic 202 may indicate to commit to a target of type A before committing to a target of type B, and if a target of type A cannot be located or identified, then commit to a target of type B before committing to a target of type C, and so on. The sensor and ATR capabilities 204 contributes sensor and ATR performance model inputs to the route evaluation criteria 112. The search manager 104 can utilize the route evaluation criteria 112, the commit logic 202, and the sensor and ATR capabilities 204 when a route is generated to determine the contribution of a generated route towards accomplishing the mission of an airborne platform or weapon system.

The environment 200 also includes a fusion track manager 206 that receives various targeting inputs as sensor input(s) 208 and data link input(s) 210 which are real-time data and platform or weapon system inputs. The sensor input(s) 208 can be received as ATR algorithm processed imaging frames generated from the various sensors on an airborne platform or weapon system, such as IR (infra-red) images, visual images, laser radar or radar images, and any other type of sensor scan and/or imaging input. The data link input(s) 210 can be received as any type of data or information received from an external surveillance or reconnaissance source, such as ground-based target coordinate inputs, or other types of communication and/or data inputs.

The environment 200 also includes target likelihoods 212, target location predications 214, and a prior scans database 216. The target likelihoods 212 are determined based on target characteristics 218 and estimated object states 220 received from the fusion track manager 206. The target location predictions 214 are determined based on modified object states 222 generated from target likelihoods 212, and based on a future time input 224 received from the route generator 102.

The target location predictions 214 transforms the modified object states 222 into projected object states 226 at the future time 224 provided by the route generator 102. The prior scans database 216 maintains parameters from previous sensor scans of regions in a target area. The prior scans database 216 provides the parameters from the previous sensor scans to the probability maps 108. The probability maps 108 combine the projected object states 226 and the parameters from the previous sensor scans from the prior scans database 216 to generate a probability map 108.

The fusion track manager 206 is described in more detail with reference to the example shown in FIG. 3. The target likelihoods 212 and the target location predications 214 are described in more detail with reference to the example shown in FIG. 4. The prior scans database 216 is described in more detail with reference to the example shown in FIG. 5, and the probability maps 108 are described in more detail with reference to the examples shown in FIG. 6. Additionally, any of the environment 200 may be implemented with any number and combination of differing components as further described below with reference to the exemplary computing-based device 1000 shown in FIG. 10.

To develop the selected route 106, the search manager 104 initiates the route generator 102 to generate a new or modified route. The route generator 102 provides the future time input 224, and the target location predictions 214 are generated as the projected object states 226 which are utilized to generate the probability maps 108 for the route generator 102. The route generator 102 also receives the navigation data 110 inputs and generates a route that is provided to the search manager 104. The search manager 104 compares the generated route to the route evaluation criteria 112 which includes the sensor and ATR capabilities 204, as well as the commit logic 202. The search manager 104 can continue to task the route generator 102 to modify or generate additional routes until the search manager 104 reaches an exit criteria which can be implemented as a threshold function of the route evaluation criteria, a limit on processing time, and/or any other meaningful exit criteria.

Figure 3:
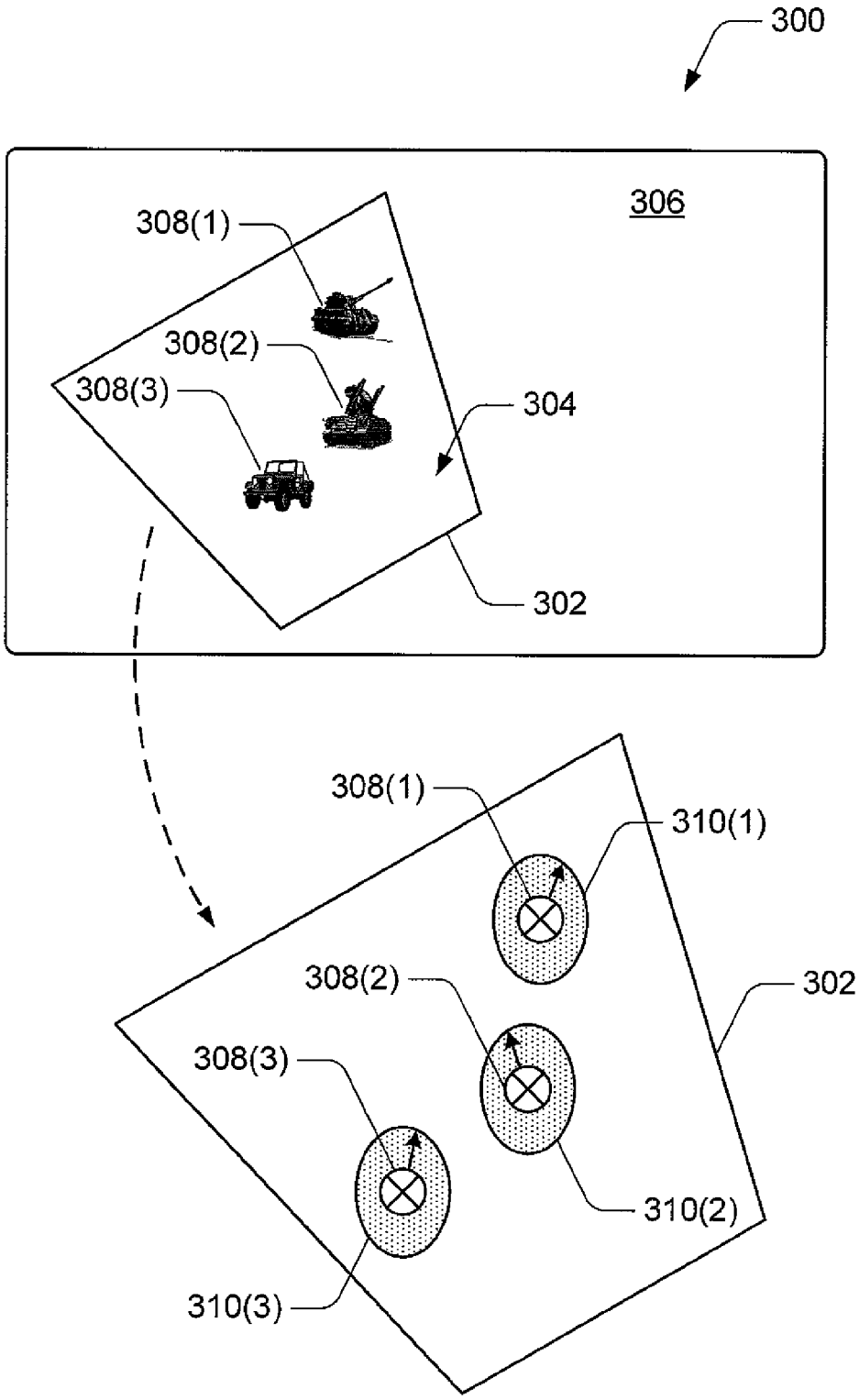
FIG. 3 illustrates an example implementation of features and/or components in the exemplary environment described with reference to FIG. 2.

FIG. 3 illustrates an example implementation 300 of the fusion track manager 206 shown in the exemplary environment 200 (FIG. 2). The fusion track manager 206 is an interface for external inputs and real-time data that are targeting inputs received as the sensor input(s) 208 and/or the data link input(s) 210. In the example implementation 300, a trapezoid represents a sensor ground coverage scan 302 of a region 304 within a target area 306, such as a visual or infra-red sensor scan. The sensor scan 302 is received by the fusion track manager 206 as an autonomous target recognition algorithm processed imaging frame and in this example, includes images of three objects 308(1-3) that are located within the scan region 304.

The fusion track manager 206 generates object probability representations from various associations and combinations of the sensor input(s) 208 and the data link input(s) 210. A sensor input 208 corresponding to an image of the sensor scan 302 includes the objects 308(1-3) and includes a likely identity of the objects, such as an indication that an object 308 is highly likely to be a first type of target and/or less likely to be a second type of target, and so on. A sensor input 208 also includes a position in latitude, longitude, and altitude of an object 308, a velocity to indicate a speed and direction if the object is moving, and an error covariance as a quality indication of the input data accuracy.

The sensor input 208 corresponding to an image of the sensor scan 302 also includes a time measurement in an absolute time coordinate, such as Greenwich mean time. The absolute time measurement also provides a basis by which to determine the current accuracy of the input as the accuracy of object positions and velocities can decay quickly over time, particularly with respect to moving military targets, or other moving objects. The sensor input 208 also includes sensor source information, such as whether the input is received from a laser targeting designator, a ground targeting system, an aircraft, or from any other types of input sources.

The fusion track manager 206 generates state estimates which includes three-dimensional position, mean, and error covariance data as well as three-dimensional velocity, mean, and error covariance data for each object 308(1-3). The three-dimensional data can be represented by latitude, longitude, and altitude, or alternatively in "x", "y", and "z" coordinates. The error covariance 310(1-3) each associated with a respective object 308(1-3) is a two-dimensional matrix containing the error variance in each axis as well as the cross terms. The error covariance pertains to the area of uncertainty in the actual position of an object 308 within the region 304 of the target area 306. The mean associated with an object 308 is the center of the uncertainty area as to where the actual position of the object is positioned (i.e., the average is the center of an "X" in a circle that represents an object 308).

A state estimate for an object 308 also includes a one-dimensional discrete identity distribution and application specific states. A one-dimensional discrete identity distribution is the likelihood that an object is a first type of target, the likelihood that the object is a second type of target, and so on. An application specific state associated with an object can include other information from which factors for targeting determinations can be made. For example, if a particular mission of a weapon system is to seek tanks, and knowing that tanks are likely to travel in a convoy, then if the objects 308(1-3) are tanks, they are likely moving together in the same direction. The state estimates for each of the objects 308 are output from the fusion track manager 206 as the estimated object states 220 shown in FIG. 2.

Figure 4:
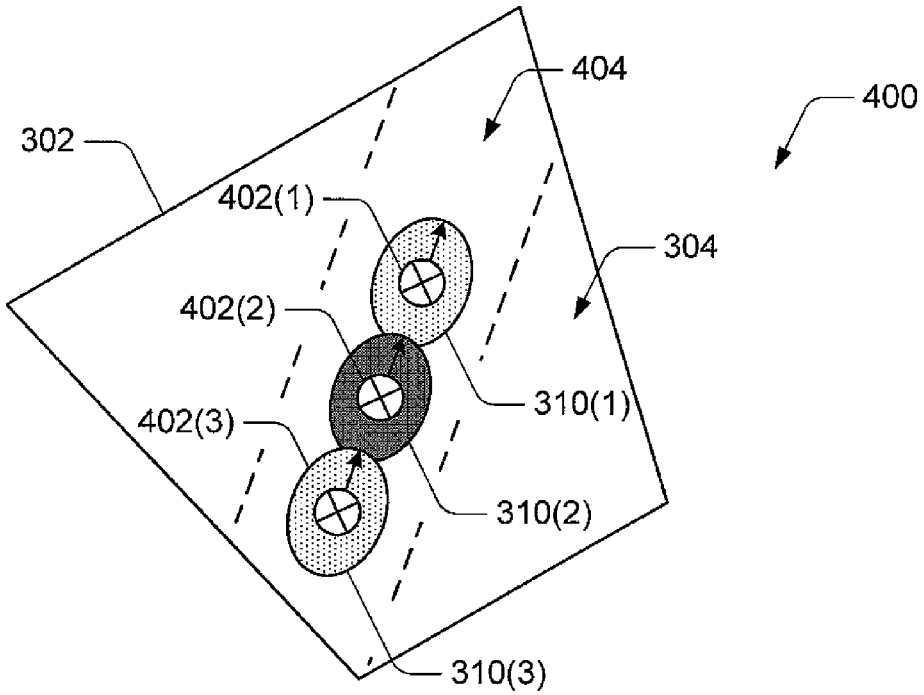
FIG. 4 illustrates an example implementation of features and/or components in the exemplary environment described with reference to FIG. 2.

FIG. 4 illustrates an example implementation of the target likelihoods 212 shown in the exemplary environment 200 (FIG. 2). The target likelihoods 212 receive the estimated object states 220 from the fusion track manager 206 and receive the target characteristics 218. The estimated object states 220 pertaining to the objects 308(1-3) described with reference to FIG. 3 are modified according to the target characteristics 218. Additionally, the objects 308(1-3) are now evaluated as possible military targets, and are identified as the targets 402(1-3) in this example implementation of the target likelihoods 212.

The target characteristics 218 can include such information about a target 402 as a likely velocity or the possible taming radius of a relocatable, moving target. Other target characteristics 218 can be utilized to determine that if a group of the targets 402(1-3) are generally traveling together and in a straight line, then the group of targets may likely be traveling on a road 404. Accordingly, the estimated object states 220 (FIG. 2) can be modified to develop and determine target likelihoods, and/or whether the targets 402(1-3) are a group traveling together, or individual targets acting independently.

Each modified object state 222 (FIG. 2) of the target likelihoods 212 is primarily a modified identity of an object 308(1-3) (FIG. 3) that was received as an estimated object state 220. A modified object state 222 still includes the three-dimensional position, velocity, and altitude of an associated target 402, as well as the modified identity of the target. In this example, target 402(2) is illustrated to represent a modified identity of the target based on its position relative to the other two targets 402(1) and 402(3), and based on the likelihood of target 402(2) moving in a group with the other two targets.

The target location predictions 214 shown in the exemplary environment 200 (FIG. 2) receive the modified object states 222 along with the future time input 224 from the route generator 102 to project target locations forward to a common point in time with the generated routes and sensor scan schedules. For example, the target location predictions 214 can be projected with a ten-second time input 224 from the route generator 102 to then predict the positions of targets 402(1-3) ten-seconds into the future, such as just over a tenth of a mile along the road 404 if the targets 402(1-3) are estimated to be capable of traveling at fifty (50) mph.

Figure 5:
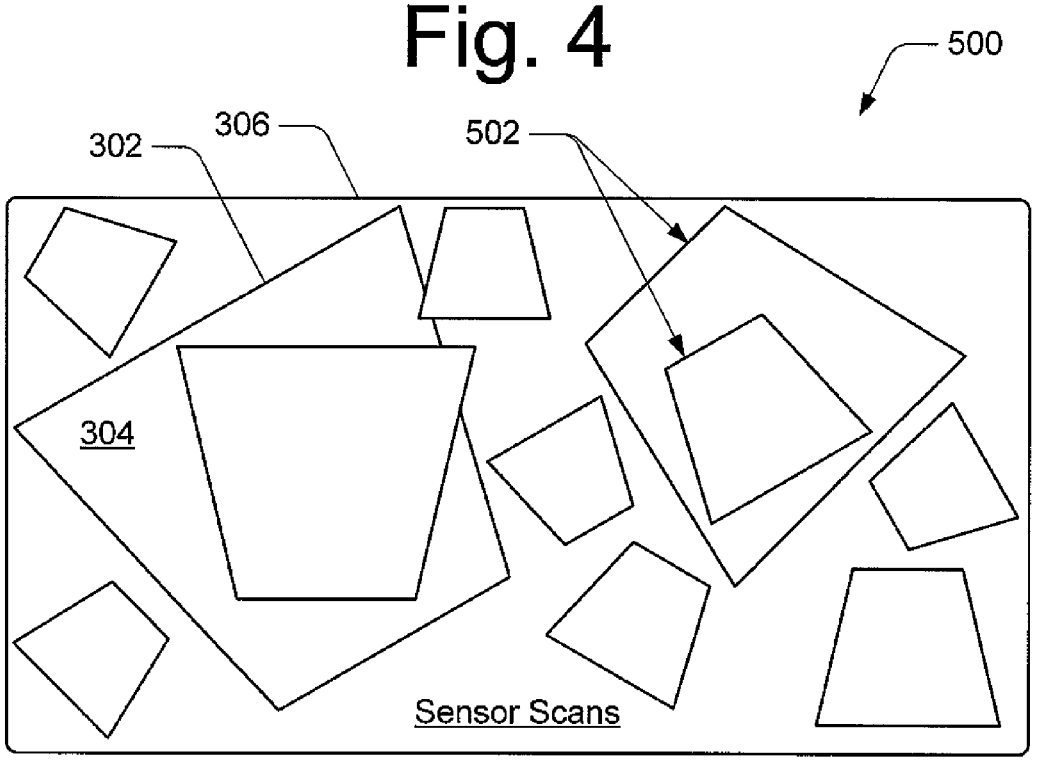
FIG. 5 illustrates an example implementation of features and/or components in the exemplary environment described with reference to FIG. 2.

FIG. 5 illustrates an example implementation 500 of the prior sensor scans database 216 shown in the exemplary environment 200 (FIG. 2). The prior scans database 216 maintains parameters from previous sensor scans 502 of various regions within the target area 306. For example, the sensor ground coverage scan 302 described with reference to FIG. 3 is illustrated as a previous sensor scan of the region 304 in the target area 306. The information associated with a previous or prior scan in the prior scans database 216 can include the type of sensor, scan pattern, direction, resolution, and scan time, as well as a position of the platform (e.g., a weapon or armament incorporating the search systems) as determined by an inertial guidance system.

Figure 6:
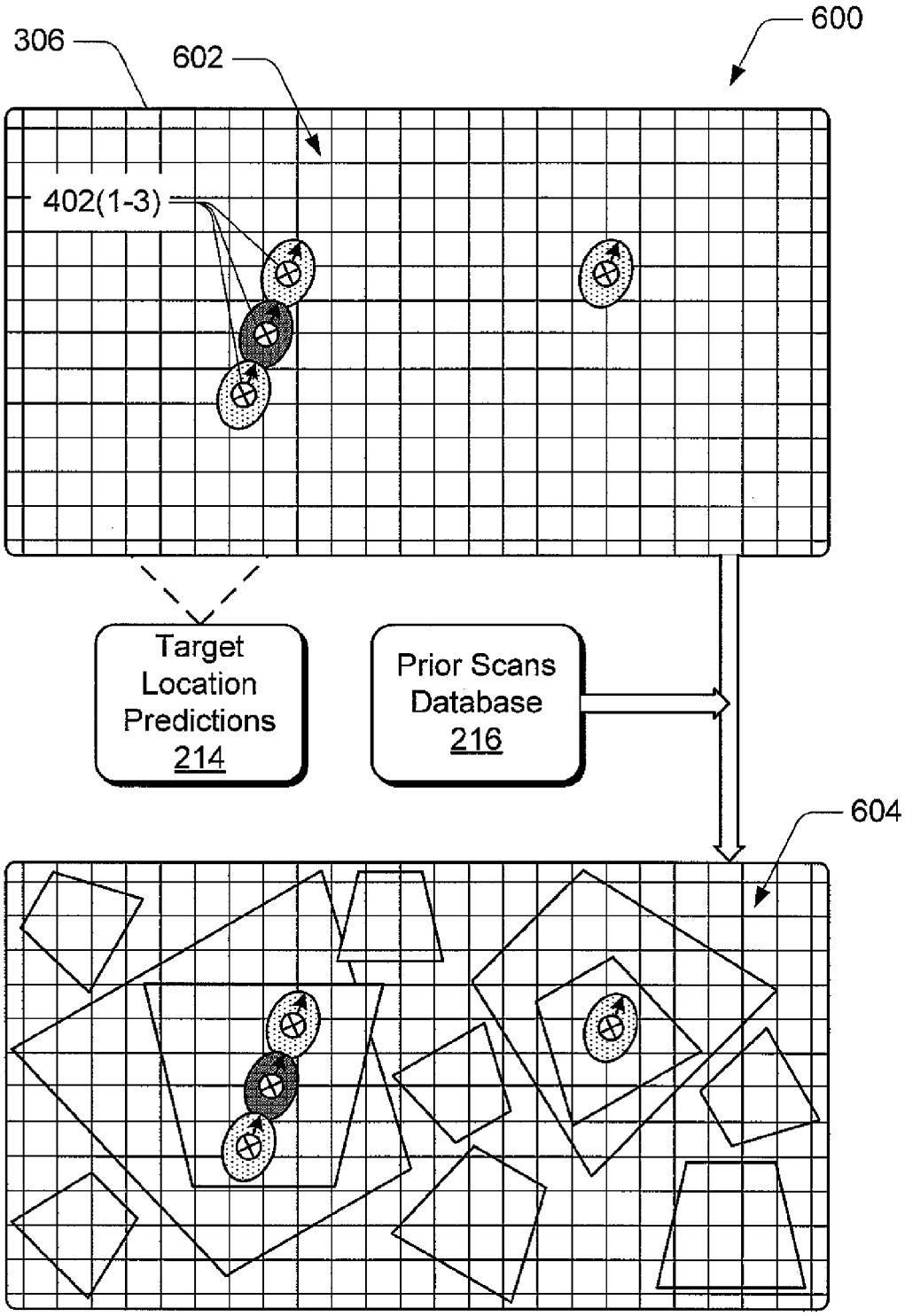
FIG. 6 illustrates an example implementation of features and/or components in the exemplary environment described with reference to FIG. 2.

FIG. 6 illustrates an example implementation 600 of the probability maps 108 shown in the exemplary environment 200 (FIG. 2), and described with reference to the route search planner system 100 (FIG. 1). The probability maps 108 combine the projected object states 226 from target location predictions 214 with prior sensor scans 502 (FIG. 5) from the prior scans database 216 to determine the conditional probability of mission accomplishment. In this example, the probability maps 108 are generated from a prior scans input 502 from the prior scans database 216 combined with an input of the target location predictions 214.

In the example implementation 600, a target location prediction 214 is illustrated as a grid of normalized cells 602 over the target area 306, and 604 illustrates the target location prediction combined with the prior scans input from the prior scans database 216. The target area 306 is divided into the cells of some quantifiable unit, such as meters or angles, and the probability of a target 402(1-3) or some portion thereof corresponding to each of the cells is normalized by standard deviation.

Generally, any of the functions described herein can be implemented using software, firmware (e.g., fixed logic circuitry), hardware, manual processing, or a combination of these implementations. A software implementation represents program code that performs specified tasks when executed on processor(s) (e.g., any of microprocessors, controllers, and the like). The program code can be stored in one or more computer readable memory devices, examples of which are described with reference to the exemplary computing-based device 1000 shown in FIG. 10. Further, the features of route search planner as described herein are platform-independent such that the techniques may be implemented on a variety of commercial computing platforms having a variety of processors.

Methods for route search planner, such as exemplary methods 700 and 800 described with reference to respective FIGS. 7 and 8, may be described in the general context of computer executable instructions. Generally, computer executable instructions can include routines, programs, objects, components, data structures, procedures, modules, functions, and the like that perform particular functions or implement particular abstract data types. The methods may also be practiced in a distributed computing environment where functions are performed by remote processing devices that are linked through a communications network. In a distributed computing environment, computer executable instructions may be located in both local and remote computer storage media, including memory storage devices.

Figure 7:
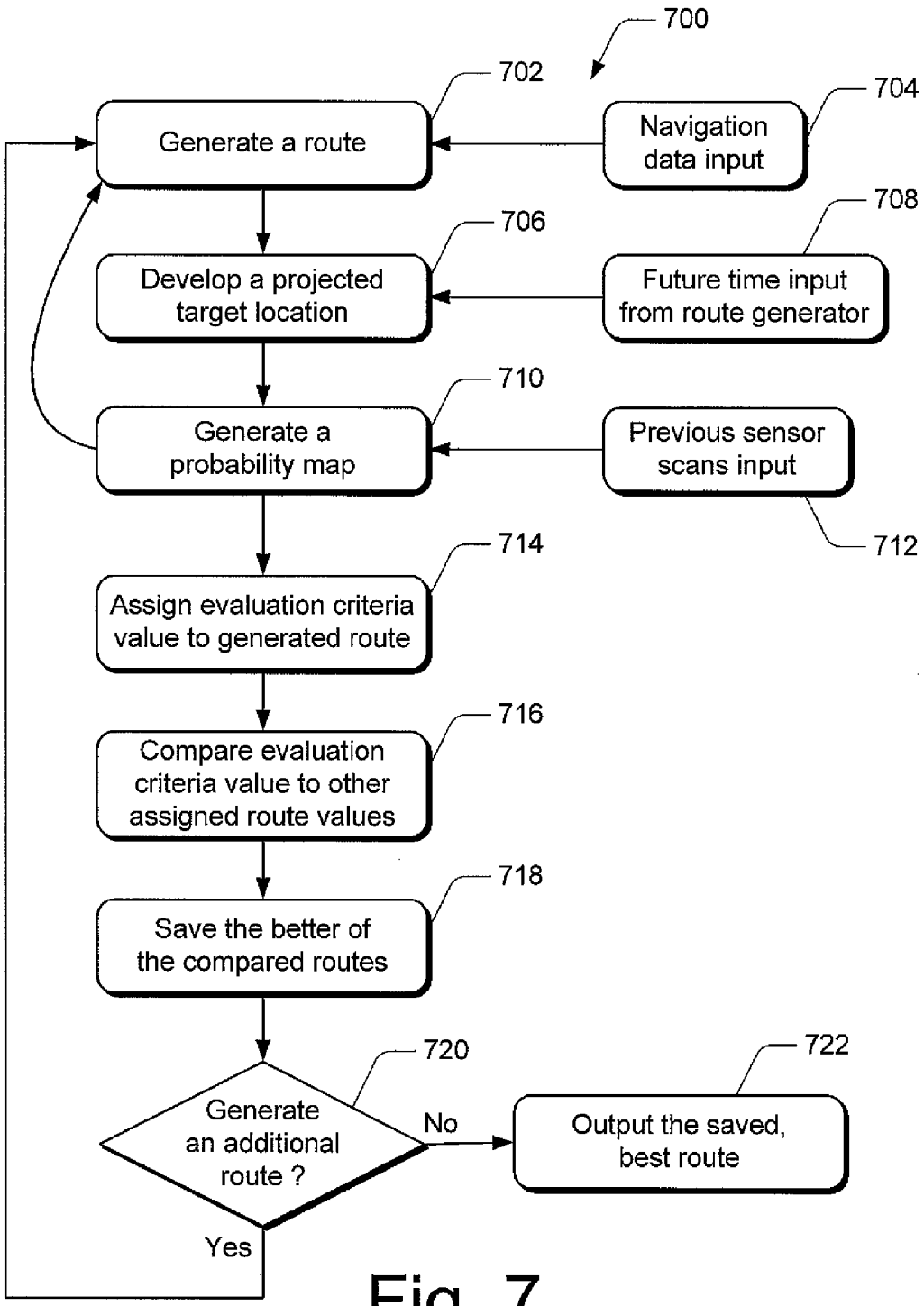
FIG. 7 illustrates exemplary method(s) implemented by the search manager in an embodiment of route search planner.

FIG. 7 illustrates an exemplary method 700 for route search planner and is described with reference to the search manager 104 and the route generator 102 shown in FIGS. 1 and 2. The order in which the method is described is not intended to be construed as a limitation, and any number of the described method blocks can be combined in any order to implement the method, or an alternate method. Furthermore, the method can be implemented in any suitable hardware, software, firmware, or combination thereof.

At block 702, a route is generated to search for relocatable target(s). For example, the search manager 104 initiates the route generator 102 to generate or modify a route, where the route is generated based at least in part on a probability map 108 (from block 710) and/or on the navigation data 110 (input at 704), and can be based on an initial route heuristic and/or a distance offset for route modification. In an embodiment, the route can be generated as a flight path for an airborne platform or weapon system to search and locate the relocatable target(s). The generation of a route by the route generator 102 is described in more detail with reference to FIGS. 8A-8B.

At block 706, a projected target location is developed based on target characteristics combined with a previously known target location projected into the future by a future time input from the route generator (at block 708). For example, a targeting input is received as a sensor scan input 208 and/or as a data link input 210, and the modified object states 222 are developed as the target location predictions 214 (i.e., "projected target locations").

At block 710, a probability map is generated from previous sensor scans combined with a projected target location of one or more relocatable targets in a target area. For example, a probability map 108 is generated at least in part from previous sensor scans (input at block 712) combined with the projected object states 226 developed at block 706.

At block 714, a generated route is assigned an evaluation criteria value. The evaluation criteria value can include, or take into consideration, the performance of the sensors, the performance of autonomous target recognition algorithms, and/or the commit logic 202 for an airborne platform or weapon system. The route evaluation criteria 112 is described in more detail with reference to FIG. 9.

At block 716, the evaluation criteria value of the generated route is compared to other evaluation criteria values corresponding to respective previously generated routes to determine an optimal generated route (e.g., which route best satisfies the route evaluation criteria). The route evaluation criteria can be any meaningful metric related to the conditional probability of mission accomplishment given the generated route, the sensor and ATR capabilities 204, and/or the commit logic 202. At block 718, the better of the two compared routes (based on the respective evaluation criteria values) is saved to be output as the selected route 106, or to be subsequently compared to additional generated routes.

At block 720, a determination is made as to whether an additional route is to be generated. For example, the search manager 104 can determine whether to generate one or more additional routes and assign additional evaluation criteria values for comparison to determine the optimal route, or the search manager 104 can otherwise reach an exit criteria such as a threshold function of the route evaluation criteria, a limit on processing time, or any other meaningful exit criteria. If an additional route is not generated (i.e., "no" from block 720), then the saved, best route is output at block 722 as the selected route 106. If an additional route is to be generated (i.e., "yes" from block 720), then the method 700 continues at block 702 to repeat the process.

Figure 8A:
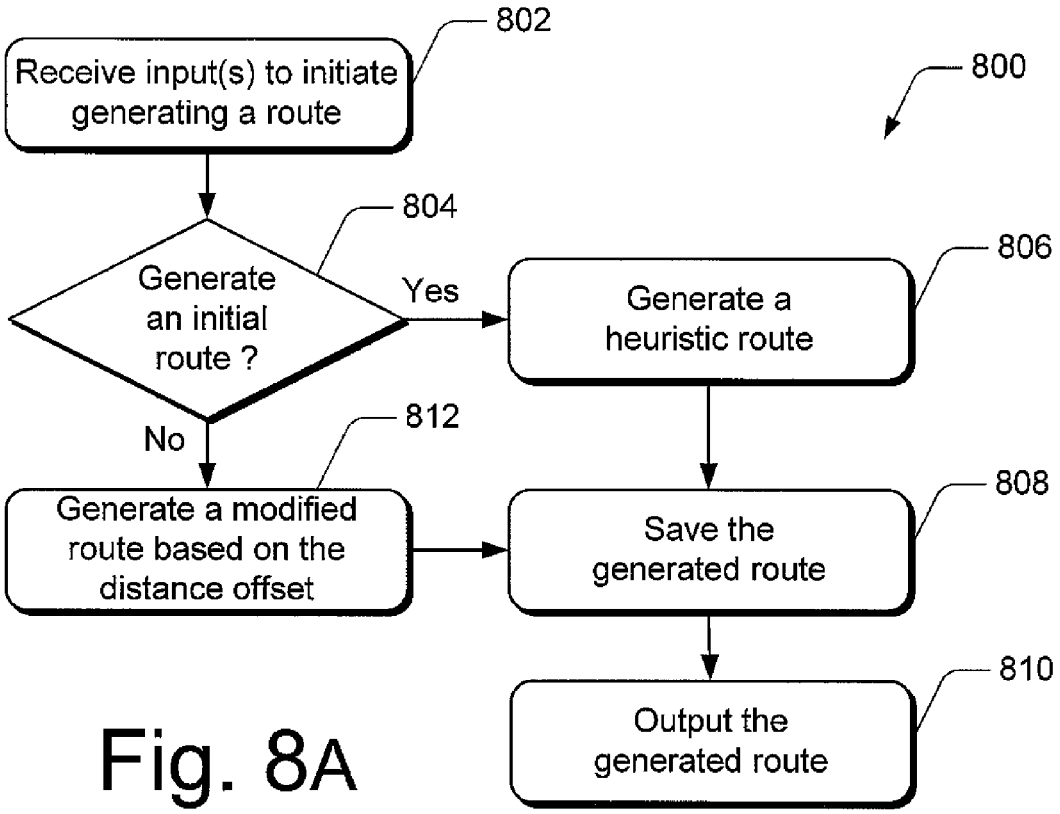
FIGS. 8A-8B illustrate exemplary method(s) implemented by the route generator in an embodiment of route search planner.
Figure 8B:
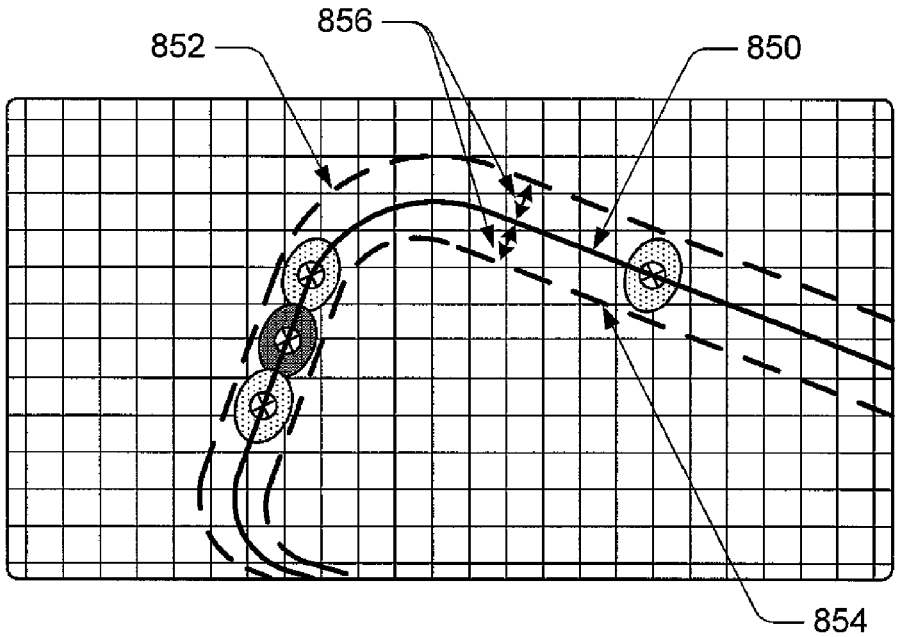

FIGS. 8A and 8B illustrate an exemplary method 800 for route search planner and is described with reference to the route generator 102 shown in FIGS. 1 and 2. The order in which the method is described is not intended to be construed as a limitation, and any number of the described method blocks can be combined in any order to implement the method, or an alternate method. Furthermore, the method can be implemented in any suitable hardware, software, firmware, or combination thereof.

At block 802, inputs are received to initiate generating a route. For example, the route generator 102 receives any one or combination of an initial route heuristic input, a distance offset or increment input, probability maps 108, and navigation data 110 when the search manager 104 initiates the route generator 102 to generate or modify a route. The initial route heuristic provides an initial, arbitrary route type on which to base generating the route, such as a straight segment, a straight segment with a circle, an arc segment, or any other types of routes generated as flight paths for an airborne platform or weapon system. The distance offset provides an incremental offset to generate a modified route from a previously generated route.

At block 804, a determination is made as to whether the route will be generated as an initial route. If the route is to be generated as an initial route (i.e., "yes" from block 804), then a heuristic route is generated at block 806. For example, the route generator 102 generates heuristic route 850 (FIG. 8B) for the greatest probability of target intersection. At block 808, the generated route is saved and, at block 810, the generated route is output. For example, the route generator 102 initiates that the generated route be maintained, and outputs the generated route to the search manager 104 for evaluation against the route evaluation criteria 112.

If the route is to be generated as a modified route (i.e., "no" from block 804), then a modified route is generated from a previous route (e.g., "dithered") based on the distance offset at block 812. For example, the route generator 102 generates a modified route 852 or 854 (FIG. 8B) based on a distance offset 856. Again, the generated route is saved at block 808, and output to the search manager 104 at block 810.

Figure 9:
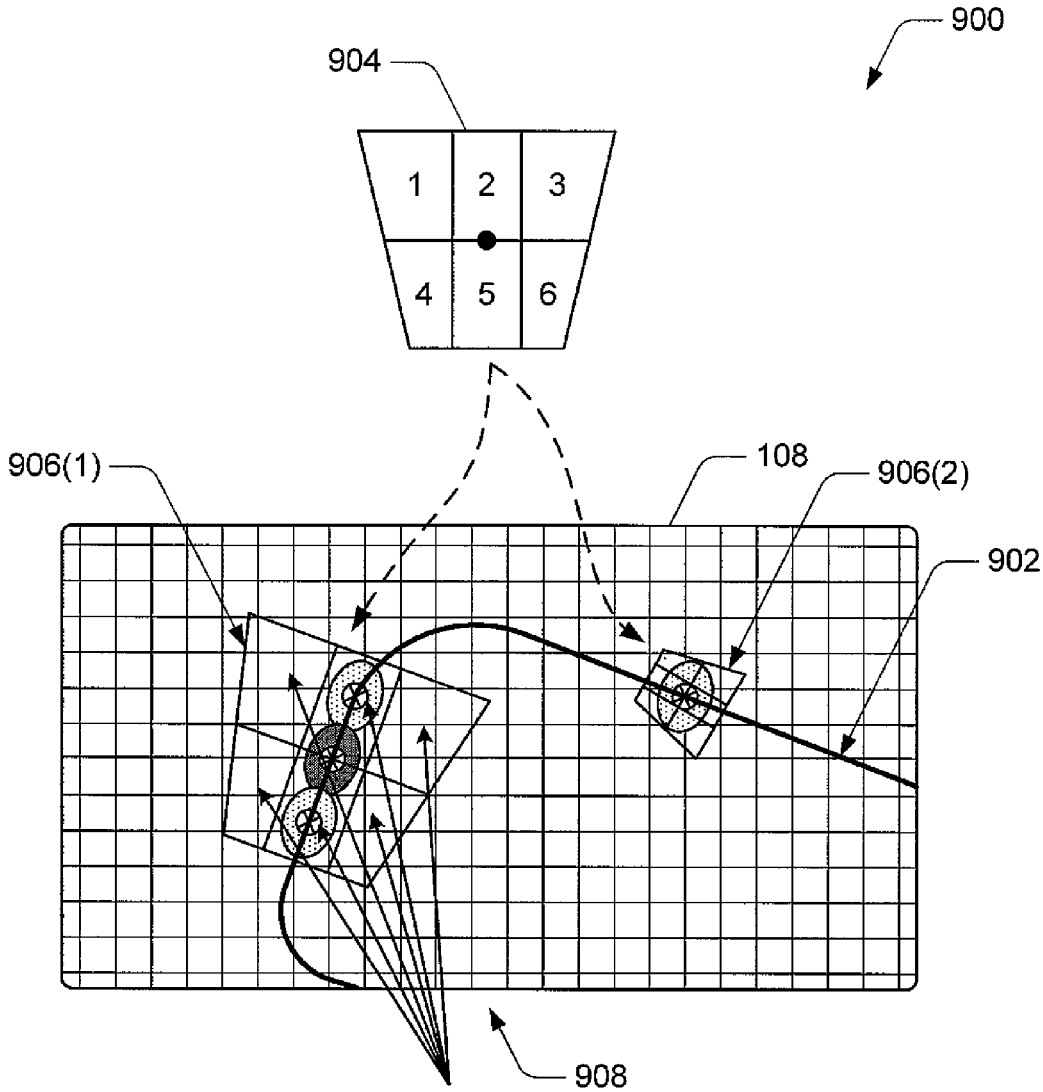
FIG. 9 illustrates example evaluation criteria in an implementation of route search planner.

FIG. 9 illustrates an example of evaluation criteria 900 in an implementation of route search planner. The evaluation criteria 900 may also be an example of the route evaluation criteria 112 described with reference to the route search planner system 100 (FIG. 1), and with reference to the environment 200 (FIG. 2). The search manager 104 can utilize the route evaluation criteria 900 to determine the conditional probability of mission accomplishment given a generated route, the sensor and ATR capabilities 204, and the commit logic 202.

In this example, a probability map 108 contains the target probabilities and the position uncertainties (as described with reference to FIGS. 3-6), as well as a generated route 902. This particular generated route 902 combined with the probability map 108 can be evaluated by the search manager 104 utilizing a field of regard method to develop the conditional probability of mission accomplishment given the generated route 902, the sensor and ATR capabilities 204, and the commit logic 202. For example, a field of regard segmented scan 904 can be overlaid on the targets at 906(1-2) to accumulate the conditional probability of mission accomplishment for each of the segmented sections of the scan 904 (i.e., illustrated at 908) to then determine the conditional probability of mission accomplishment.

Other route evaluation criteria 112 that may be utilized by the search manager 104 to evaluate a generated route is an ATR algorithm dependency factor which indicates the statistical dependency of ATR results produced from sensor scans of the same area which are close in time, have similar relative geometries, were produced by different sensors, or were produced by different ATR algorithms. Other evaluation criteria 112 may also include such information as the sensor scan modes, to include indications of low or high resolution scans, wide or narrow field of views, long or short range scans, and other various sensor modality information. In addition, the search manager 104 may include such data as the platform velocity vector which can be obtained or received as the navigation data 110.

Figure 10:
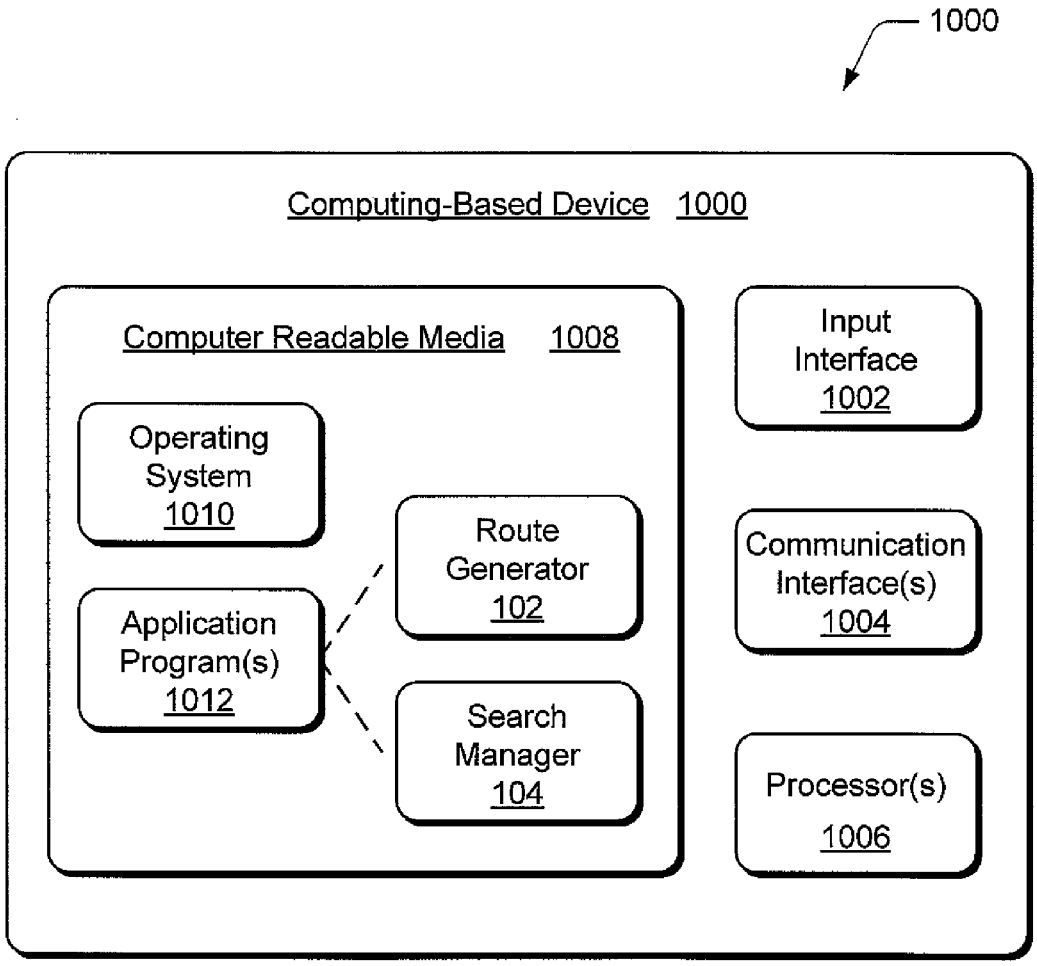
FIG. 10 illustrates various components of an exemplary computing-based device in which embodiments of route search planner can be implemented.

FIG. 10 illustrates various components of an exemplary computing-based device 1000 which can be implemented as any form of computing or electronic device in which embodiments of route search planner can be implemented. For example, the computing-based device 1000 can be implemented to include any one or combination of components described with reference to the route search planner system 100 (FIG. 1) or the exemplary environment 200 (FIG. 2).

The computing-based device 1000 includes an input interface 1002 by which the sensor input(s) 208, the data link input(s) 210, and any other type of data inputs can be received. Device 1000 further includes communication interface(s) 1004 which can be implemented as any one or more of a serial and/or parallel interface, a wireless interface, any type of network interface, and as any other type of communication interface.

The computing-based device 1000 also includes one or more processors 1006 (e.g., any of microprocessors, controllers, and the like) which process various computer executable instructions to control the operation of computing-based device 1000, to communicate with other electronic and computing devices, and to implement embodiments of route search planner. Computing-based device 1000 can also be implemented with computer readable media 1008, such as one or more memory components, examples of which include random access memory (RAM), non-volatile memory (e.g., any one or more of a read-only memory (ROM), flash memory, EPROM, EEPROM, etc.), and a disk storage device. A disk storage device can include any type of magnetic or optical storage device, such as a hard disk drive, a recordable and/or rewriteable compact disc (CD), a DVD, a DVD+RW, and the like.

Computer readable media 1008 provides data storage mechanisms to store various information and/or data such as software applications and any other types of information and data related to operational aspects of computing-based device 1000. For example, an operating system 1010 and/or other application programs 1012 can be maintained as software applications with the computer readable media 1008 and executed on processor(s) 1006 to implement embodiments of route search planner. For example, the route generator 102 and the search manager 104 can each be implemented as a software application component.

In addition, although the route generator 102 and the search manager 104 can each be implemented as separate application components, each of the components can themselves be implemented as several component modules or applications distributed to each perform one or more functions in a route search planner system. Further, each of the route generator 102 and the search manager 104 can be implemented together as a single application program in an alternate embodiment.

Although embodiments of route search planner have been described in language specific to structural features and/or methods, it is to be understood that the subject of the appended claims is not necessarily limited to the specific features or methods described. Rather, the specific features and methods are disclosed as exemplary implementations of route search planner.

The invention claimed is:

1. A method of planning a route for a vehicle including onboard sensors, the method comprising:

(a) using an initial route to generate a plurality of possible new routes that the vehicle could follow during a mission, wherein generating the plurality of possible new routes includes generating a probability map from previous sensor scans combined with a projected target location of one or more relocatable targets in a target area; and generating new routes by which to search for at least one of the relocatable targets, the new routes being generated based at least in part on the probability map;

(b) determining a contribution towards mission accomplishment that would result from utilization of the sensors along each possible new route, wherein determining the contribution includes assigning an evaluation criteria value to the new routes based on route evaluation criteria, the evaluation criteria value being comparable to one or more evaluation criteria values corresponding to respective previously generated routes to determine an optimal route;

(c) using the contributions to select one of the possible new routes, where the selected route results in a larger contribution towards mission accomplishment; and (d) returning to step (a) but using the selected route to generate a plurality of possible new routes;

whereby a route that best accomplishes the mission is iteratively produced.

2. The method of claim 1 wherein each new route is generated as a flight path for an airborne platform to search and locate the at least one relocatable target.

3. The method of claim 1, wherein the previous sensor scans include previous sensor scans of a region in the target area, and wherein the generation of the new routes is additionally based at least in part on an initial route heuristic.

4. The method of claim 1, further comprising developing the projected target location based on target characteristics combined with a previously known target location projected into the future by a future time input.

5. The method of claim 4, further comprising: receiving a targeting input as at least one of: a sensor scan input; a data link input; and determining the previously known target location from the targeting input.

6. The method of claim 1, wherein the vehicle also includes autonomous target recognition capability, and wherein the evaluation criteria is based on a probability-based prediction of onboard sensor and autonomous target recognition performance.

7. The method of claim 1, wherein the vehicle also includes commit logic containing mission-specific criteria for determining whether the vehicle can commit to a particular target, including at least one of the likelihood the vehicle can reach an object, the likelihood the object is of a mission-desired type, and the likelihood the object is the desired object; and wherein the evaluation criteria is based on a probability-based prediction of onboard sensor performance and commit logic processing.

8. The method of claim 1, wherein determining the contribution includes generating a mission probability model of uncertainty from previous sensor scans, and determining a conditional probability of accomplishing the mission given the new possible route.

9. The method of claim 8, wherein the model includes estimated types and kinematics of objects in the vehicle's environment as well as the ability to project the current model, and its uncertainty, into a future time.

10. The method of claim 8, wherein accomplishing the mission includes searching, recognizing, and committing to a target in a region; and wherein the probability model includes representations of the target in the region.

11. The method of claim 1, wherein the vehicle is an airborne platform, and wherein the routes are flight paths for the airborne platform.

12. The method of claim 1, wherein the evaluation criteria is based on a model that characterizes new information gained from utilizing the on-board sensors and also information gained from previous sensor scans.

13. The method of claim 1, wherein at step (a) a route generator is re-initialized with a selected route that has a larger probability of mission accomplishment.

* * * * *